US008127707B2

(12) United States Patent
Birkin

(10) Patent No.: US 8,127,707 B2
(45) Date of Patent: Mar. 6, 2012

(54) LOCATION INDICATOR DEVICE

(76) Inventor: Jeffrey Birkin, Cheddar Somerset (GB)

( * ) Notice: Subject to any disclaimer, the term of this patent is extended or adjusted under 35 U.S.C. 154(b) by 0 days.

(21) Appl. No.: 13/001,935

(22) PCT Filed: Jul. 3, 2009

(86) PCT No.: PCT/GB2009/050789

§ 371 (c)(1),
(2), (4) Date: Dec. 29, 2010

(87) PCT Pub. No.: WO2010/004318

PCT Pub. Date: Jan. 14, 2010

(65) Prior Publication Data

US 2011/0100289 A1 May 5, 2011

(30) Foreign Application Priority Data

Jul. 9, 2008 (GB) ..... 0812591.6

(51) Int. Cl.
*B63C 9/15* (2006.01)
*B63C 9/20* (2006.01)

(52) U.S. Cl. ..... 116/210

(58) Field of Classification Search ..... 116/210, 116/209, DIG. 8, DIG. 9, 63 P; 114/311; 441/89, 7, 8, 11, 20, 30, 31, 95, 97, 100; 40/610

See application file for complete search history.

(56) References Cited

U.S. PATENT DOCUMENTS

| | | | | |
|---|---|---|---|---|
| 2,486,158 | A * | 10/1949 | Haas | 244/33 |
| 3,031,693 | A * | 5/1962 | Kirby | 441/26 |
| 3,224,001 | A * | 12/1965 | Radnofsky et al. | 342/8 |
| 3,877,096 | A * | 4/1975 | Scesney | 441/6 |
| 3,952,694 | A * | 4/1976 | McDonald | 116/209 |
| 4,498,882 | A | 2/1985 | Evert | |
| 4,573,933 | A | 3/1986 | Cameron | |
| 4,725,252 | A | 2/1988 | McNeil | |
| 4,809,638 | A * | 3/1989 | Kolesar et al. | 116/26 |
| 5,000,111 | A * | 3/1991 | Gibson | 116/209 |
| 5,344,351 | A * | 9/1994 | Danielson | 441/89 |
| 5,421,287 | A * | 6/1995 | Yonover | 116/209 |
| 5,736,954 | A * | 4/1998 | Veazey | 342/8 |
| 6,106,349 | A * | 8/2000 | Motosko | 441/129 |
| 6,332,823 | B1 * | 12/2001 | Rouse, Jr. | 446/220 |
| 6,368,174 | B1 | 4/2002 | Magee | |
| 6,409,561 | B1 * | 6/2002 | Ibasfalean | 441/93 |
| 6,415,734 | B1 * | 7/2002 | LaPuzza | 116/201 |
| 6,935,912 | B1 * | 8/2005 | Myers | 441/89 |
| 2005/0045088 | A1 * | 3/2005 | Martin | 116/210 |
| 2007/0006498 | A1 * | 1/2007 | Collins | 40/610 |
| 2007/0008712 | A1 * | 1/2007 | Schnitzer et al. | 362/96 |
| 2007/0238373 | A1 | 10/2007 | Henrikson | |
| 2009/0013574 | A1 * | 1/2009 | Palmer | 40/610 |

FOREIGN PATENT DOCUMENTS

DE 8631202 3/1987

(Continued)

*Primary Examiner* — Richard A. Smith
(74) *Attorney, Agent, or Firm* — Colin P. Cahoon; Celina M. Orr; Carstens & Cahoon, LLP

(57) ABSTRACT

There is provided a object locator device, convertible between an undeployed state and a deployed state, comprising an inflatable portion (2) of at least two linear portions arranged such that the angle between them is less than 180° when the device is in the deployed state, each linear portion being attached to an indicator portion (15) formed by a sheet, means for attachment of the device to the object at one or more pivot points and means (62) for inflation of the inflatable portion.

19 Claims, 4 Drawing Sheets

FOREIGN PATENT DOCUMENTS

| | | | |
|---|---|---|---|
| FR | 2598541 A1 | * | 11/1987 |
| GB | 1559901 | | 1/1980 |
| GB | 2394449 | | 4/2004 |
| JP | 05319375 A | * | 12/1993 |
| WO | 9924314 | | 5/1999 |
| WO | 0015494 | | 3/2000 |

* cited by examiner

Figure 2
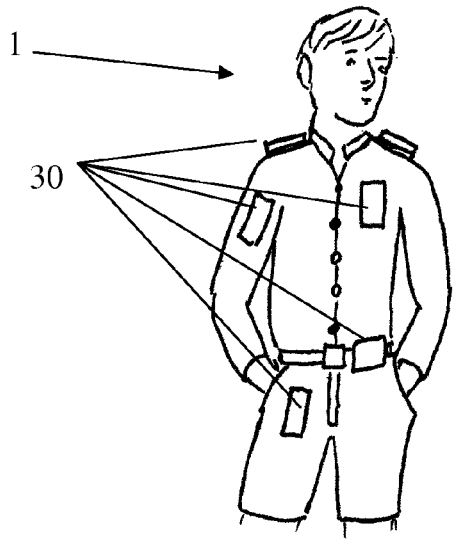
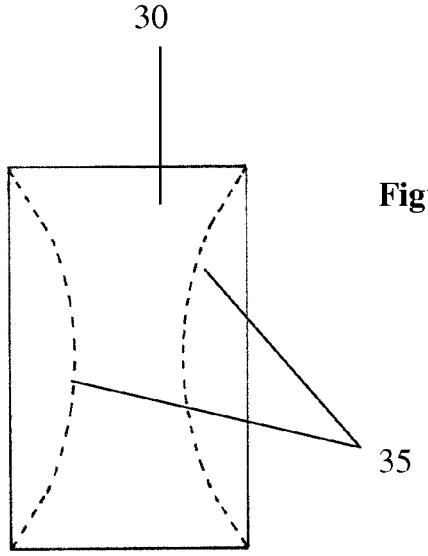
Figure 3
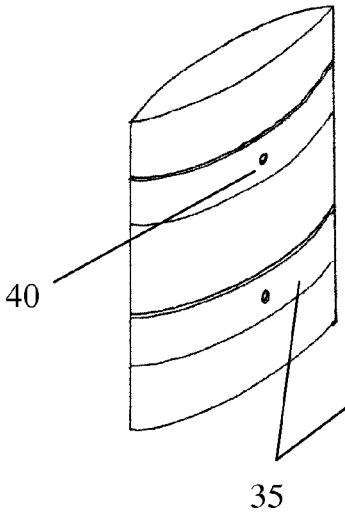
Figure 4
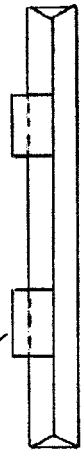
Figure 5
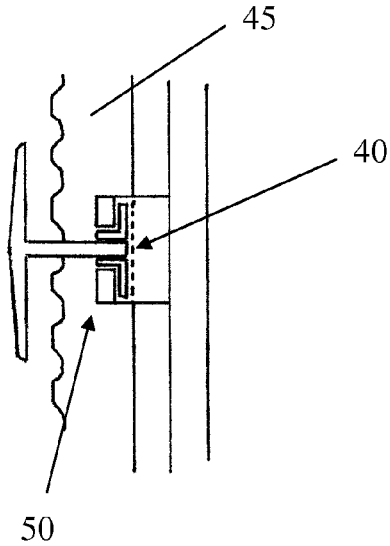
Figure 6

Figure 9
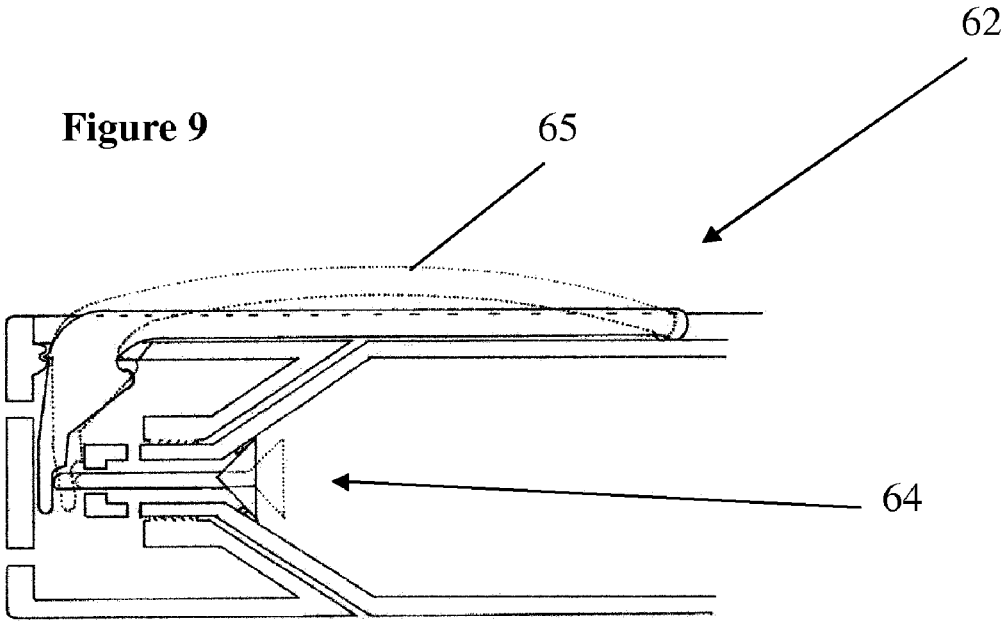
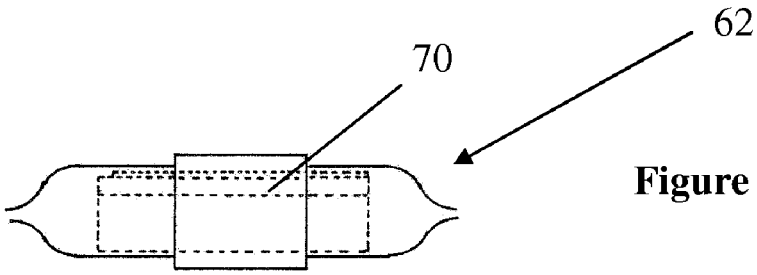
Figure 10
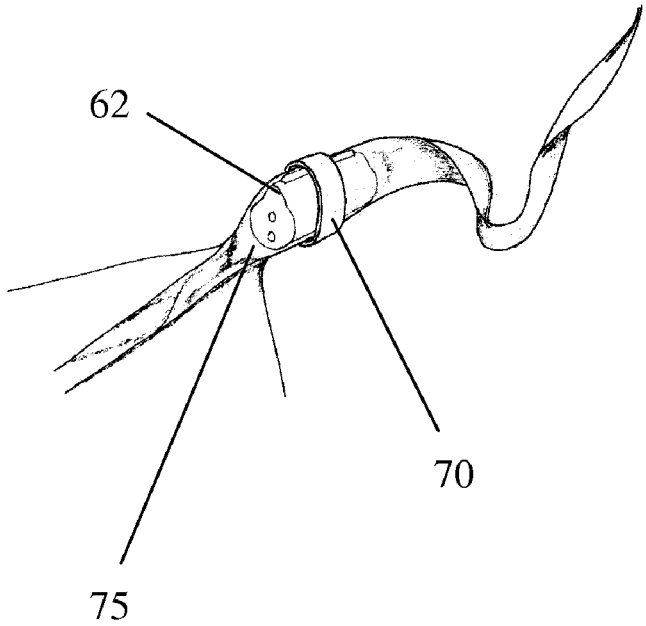
Figure 11

LOCATION INDICATOR DEVICE

FIELD OF INVENTION

The invention relates to a device for visualising the location of an object, especially an individual in water and particularly in open water on a river or sea.

BACKGROUND

When a person has fallen from a vessel or otherwise finds him/herself unavoidably in the sea or other areas of open water, they are referred to as a 'casualty'. This is due to the fact that exposure to such conditions can quickly cause numerous physical consequences that eventually may lead to the death of the person. In the absence of life-preservers, buoyancy aids or proper protection, survival limits can often be measured in minutes. Even with such aids, time is usually incredibly valuable for the survival of the person, even if they stay afloat. Too often, the delay in finding the person alive results in their subsequent death despite the best medical care available.

Professional seafarers, as well as leisure craft users, often only don life jackets at night or when conditions deteriorate. However, the majority of accidents occur when people least anticipate a problem and, even when sailing on a calm and sunny day or conducting a routine operation aboard ship, there is no guarantee that an incident will not occur which could result in a member of the crew or a passenger falling overboard. This may occur at a time when the rest of the crew are least able to respond.

Generally, life preservers themselves add very little extra visibility to an individual in the water and so a person in the water presents a very small object when viewed from rescue aircraft and boats. It is well known to sailors that large objects can readily be concealed by moderate seas and smaller objects, such as a person in a life jacket, are therefore often invisible when no more than a few metres from a vessel. In view of the problems of exposure to the elements and not being able to sustain visual contact with the casualty, a man-overboard should always be treated as a life threatening situation with the consequent emergency 'Mayday' response.

Emergency response can vary with location, conditions and time of day. Lifeboats are no different from any other similar sized vessel, generally offering a poor observation vantage point for a casualty as he/she rises then dips below the horizon created by every wave. Even aircraft, unless fitted with highly sensitive heat detection equipment, can find it very difficult to identify such casualties until within a few metres of their location. Yet throughout this, casualties who survive often tell of the frustration of being able to see their would-be rescuers from great distances, even though they themselves cannot be seen.

The options currently available are either complex electronic 'alerting' systems or bulky pieces of personal equipment, unlikely to be worn at all times. Initial cost and maintenance levels are relatively substantial and electronic components often fail when suffering the consequences of impacts, salt water and time. Electronic Position Indicator Beacons (EPIRB) will typically give a location to within a mile and GPS-enabled EPIRB to within 50 metres, provided the GPS receiver can make contact with the required satellites. In some circumstances, this could require the user to hold the unit clear of the water in order to make and maintain such satellite contact. A further problem associated with some electronic systems is that accidental actuation of transmitters in close proximity to certain aviation electronics systems has caused concern, with the result that some devices have been withdrawn from service.

Although these electronic devices can, subject to the above limitations, assist greatly with providing a general location of a casualty, they do little to enhance the visual profile of the casualty. No rescue of the casualty can begin until the search is complete, such that there is a visual acquisition of the casualty. Pyrotechnic devices and lights can assist, although they all have obvious drawbacks (such as poor to zero visibility in daylight), that have prevented them being routinely worn or carried.

Previous attempts to provide devices which will increase visibility of a user when in the water include that disclosed in, for example, U.S. Pat. No. 4,725,252. This discloses a flotation device incorporating an indicator "streamer" or band member which, before deployment, is rolled up and worn in a belt by the user. When the user jumps into the water, the streamer is deployed and then extends from under the body and head of the wearer onto the surface of the water (with airbags fitted to the overall device causing the wearer to be positioned on their backs in the water). The streamer is kept afloat on the surface by the inclusion of gas-filled chambers positioned along the length only of the streamer. There are several problems with the system. For example, if the casualty was in the water in very low wind conditions the streamer would tend to wrap around them. In rougher, windier conditions, the casualty must position themselves so as to be facing into the wind-driven spray and waves, to avoid the streamer from becoming entangled with their legs. This clearly poses an additional risk to the user and increases the likelihood of ingestion of water. Any entanglement could upset buoyancy, increasing the risk of the casualty's airway being beneath the surface of the water. In addition, there are no means included in the streamer to encourage it to form the greatest possible surface area, apart from the longitudinal chambers. Deflation of even one of these could cause the streamer to fold along its longitudinal axis and become less visible.

GB2394449 discloses a "Life Lily" in which a user is to place themselves within a central pocket which is to be surrounded by a circle of indicator material, kept afloat by radial gas-filled chambers. It is intended that the indicator material be deployed after the user has placed himself within the central pocket or "body boot", deployment usually to occur once in the water. In fact, the pressure and volume of gas required to inflate a large area of material after immersion in water would be great and, in reality, the indicator portion would be unlikely to fully deploy across the surface of the water, especially in rough seas and/or windy weather. The material would be more likely to become entangled around the user who may find it difficult to combat this, in view of his position within the body boot. In addition, due to the circular nature of the indicator portion, the parts facing into wind and waves (even it could be fully deployed) would be likely to drift, flip or fold over the user and become entangled with him.

Therefore, there is a need to provide a simple, low-cost device which can be routinely worn by a user when aboard a boat or an aircraft crossing water and which, when deployed, greatly increases the visibility of a person in the water, without posing a significant risk of additional harm to them as the result of entanglement with the device. Such a device can also be used on land.

SUMMARY OF INVENTION

According to a first aspect of the invention, there is provided an object locator device, convertible between an undeployed state and a deployed state, comprising an inflatable portion of at least two linear portions arranged within the device such that the angle between them is less than 180° when in the deployed state, each linear portion being attached to an indicator portion formed by a sheet, means for attachment of the device to the object at one or more pivot points and means for inflation of the inflatable portion. Preferably, the device is for use in locating a floating object or an object partly or fully submerged in a liquid, typically water.

Preferably, the linear portions of the inflatable portion are formed at less than about 150°, about 140°, about 130° or about 120° to each other, preferably at less than about 110° or less than about 100° to one another, most preferably at about 90° to one another. In a preferred arrangement, the inflatable portion is formed from linear portions arranged in approximately a "T" or "+" shape. Other suitable arrangements of linear portions of the inflatable portion will be obvious to the skilled person, for example an "L" shape. "H", "X", "Z" and "W" shapes all provide possible alternatives. None of these suggestions should be considered to be limiting.

The required level of inflation will vary according to the model and which latitude and/or sea and/or air temperature it is designed to operate in and the conditions that the wearer anticipates. Few leisure sailors would allow themselves to be out in wind conditions above F7, whilst professional fishermen routinely work in worse than F8. A device used in Arctic waters would require greater volumes of gas for a given sea state than a similar sized unit for use in the Caribbean. The skilled person will readily be able to determine the required level of inflation for any given model of the device, for use in particular conditions.

Advantageously, the arrangement of the indicator portion (for example, formed by a sheet of material) being attached to the linear portions (for example, attached along the length of the linear portions) and the positioning of the two linear portions of the inflatable portion at less than 180° relative to one another, has the effect of maintaining the device in an "open" or "flat" configuration when the device is deployed and, for example, attached to an object floating in a liquid such as water. The overall surface shape and area of the indicator is maintained such that significant folding or entanglement does not occur. The indicator portion "rides the waves", remaining at or near the surface of the water and not suffering any of the prior art problems of tending to gather around the object and/or to sink below the surface.

The indicator portion may be attached along the whole of the length of each of the linear portions, or along part of the length, or along the whole or a part of the length but attached at discrete points. Alternatively, the inflatable portion may be formed by the material forming the indicator portion, such that the indicator portion and inflatable portion are of unitary construction, with the inflatable portions being sealed within the material of the indicator portion. This may be achieved by, for example, the use of two or more sheets of material which are sealed together so as to form one or more enclosed spaces formed between sheets, the enclosed spaces forming the inflatable portion.

A further advantage is provided by the attachment of the device to the object at a pivot point. This means that the device is attached to the object at a point around which the device as a whole is free to move and does not extend as a "ribbon" or a band of material with the whole end of the band being attached to the object. Therefore, the device is free to move in accordance with the action of wind and/or the movement of liquid (usually water) surrounding the object, such that the device does not become entangled with the object and maintains an "open" or "flat" configuration visible from nearby craft. However, the device may be attached to the object at more than one pivot point provided that this freedom to move in accordance with wind/water action is maintained when the device is in the water. This benefit is enhanced in a preferred embodiment in which the means for attachment comprises a tether, line or other length of material which spatially separates the user from the indicator portion when the device is deployed and worn by a user partly or fully submerged in water.

The device provides a large area of highly visible material on the surface of the water when in the deployed state, to visually identify the position of a casualty. When deployed, the area of material is held in a pre-determined shape and kept buoyant by the inflatable portion. Since the basic structure is maintained in this way, the deployed device "rides the waves", i.e., remains on or near the surface of the water in an "open" or "flat" configuration.

Preferably, the object is a person or the clothing or footwear worn by a person, but it may also be an object to be worn by or used by a person, such as (but not limited to) a lifejacket, life raft or other buoyancy aid, a bag, a container such as a box, a tool and/or tool belt.

The device is convertible between an undeployed state, in which it is packaged to form a compact unit locatable on the surface of the object, and a deployed state in which the inflatable portion is inflated. The compact unit may, for example, take the form of a patch or badge to be worn on the clothing of a person or on the surface of another object. This has the advantage that, in the undeployed state, the device is small and can be worn routinely without impairing freedom of movement of the user as can be the case with, for example, personal buoyancy aids. In addition, the device can be affixed to the surface of buoyancy aids and other emergency equipment without adversely affecting the deployment and operation of such equipment.

Preferably, one linear portion is inflatable independently from another linear portion, so that deflation of one linear portion does not result in deflation of the whole inflatable portion. Each linear portion of the inflatable portion may be formed by a single inflatable chamber, or may comprise a series of inflatable chambers, either linked to one another or formed discretely from one another. Each inflatable chamber may be individually inflatable, or inflatable by connection to one or more other inflatable chambers.

The inflatable portion may be inflatable by gas or another substance such as water reactive foam. Inflation may be triggered automatically (for example on contact with water), or manually, or by a combination of automatically- and manually-activated systems.

The means for inflation included in the device may comprise, for example, a pressurized gas container which, when triggered, releases gas into the inflatable portion. In one embodiment, triggering of such a container may be prevented by trigger means formed from a soluble material such that, when the trigger means is contacted by water or other liquid into which the object has fallen, the trigger means dissolves, thereby activating the release of gas from the gas container. The gas container may be connected to the inflatable portion of the device by any conventional means and may further be mounted on or within the device by means which will readily be determined by the skilled person.

The device may further comprise manual inflation means such as a tube which may comprise a one-way valve.

All or a part of the device, particularly that forming the indicator portion, may be formed from a high visibility material. High visibility material may be material which is visible to the naked eye, such as brightly coloured and/or fluorescent and/or reflective material. Alternatively or additionally, the material may be visible by other detection means, for example it may be a radar reflective material or a material detectable using sonic methods. In any embodiment, the material may be a plastics or fabric material such as linear low density polyethylene (LLDPE) or Mylar®, by way of non-limiting example. The material may be biodegradable.

The indicator portion may have a thickness of at least approximately 50 μm. One factor in determining an appropriate thickness is colour density which may be further reduced in water, such that less than 50 μm can become transparent in the case of some materials. The sheet forming the indicator portion may be a constant sheet of material or may comprise one or more apertures, for example it may be a material such as gauze or netting. Any material or combination of materials is suitable provided it has sufficient visibility, detectable by visual means or other means such as radar or sonic systems.

In a preferred embodiment, the indicator portion of the device comprises at least one flotation vent. Such a flotation vent may be a simple opening within the material forming the indicator portion such that, when a liquid flows across the surface of the material (for example, by the action of a wave moving across the material), the liquid moving through the opening encourages the material to move towards the surface of the water and/or maintain a substantially flat configuration. Therefore, the action of waves on the water will assist (along with the use and relative positioning of the linear portions of the inflatable portion of the device) with maintaining the device in a substantially "open" or "flat" configuration, riding on the surface of the water and over the surface of any waves present in the water. The flotation vent may be designed and shaped by means which will be understood by the skilled person, for example, by means of shaping the material of the indicator portion to form an arch or tunnel structure, or by inclusion of vents, valves, lattices or other structures to enable the flow of water through the device so as to encourage the indicator portion to be located at or near the surface of the water. One or more sea anchors (also known as drift anchors) may also be employed as part of the device.

The device may carry any other safety and/or attention-seeking aids as may be required, such as lights and whistles, for example.

Another aspect to the design is for the indicator to be of a larger area, suitable for use with life rafts and other similar equipment. There may also be the same system components utilised for mountainous environments, rivers and other remote or camouflaging areas.

According to a second aspect of the invention, there is provided a method of visualising or visually locating an object comprising attaching to the object a device according to the first aspect of the invention. Preferably, the object is floating on, or is fully or partly submerged in, a liquid such as water. The object may be a person or clothing or footwear or another object worn by or affixed to a person. Preferably, the method includes the step of converting the device from an undeployed to a deployed state.

BRIEF DESCRIPTION OF FIGURES

Embodiments of the invention will now be described, by way of example only, with reference to the accompanying FIGS. 1-11 in which:

FIG. 2 shows examples of the device in the undeployed state being worn by a user;

FIG. 3 illustrates the front of the package worn by the user in FIG. 2 with tear lines or lines of weakness engineered into the package allow for the device to be deployed;

FIG. 4 shows a view from the rear of the device of FIG. 3 showing a system including straps suitable for belt and epaulet location, as well as fixing holes for a pin attachment system;

FIG. 5 is a side view of the device of FIGS. 3 and 4;

FIG. 6 shows a design that may be utilised for a pin fixing system attaching the device to clothing which is flimsy or light-weight;

FIG. 9 shows a design that may be suitable for a gas cartridge and valve system;

FIG. 10 shows the cartridge and trigger of FIG. 9 within the inflatable cell showing a soluble band surrounding the gas cartridge preventing inflation; and FIG. 11 illustrates a cartridge that may be used as shown in FIG. 10, where the cartridge and valve system have been inserted into an inflatable cell close to the indicator portion and prevented from activation by a soluble band or sheath.

EXAMPLE

The Man Overboard Location Indicator Device is a system which brings together core components and adapts those technologies to fit into a relatively small badge, epaulet, patch or package. Due to the small size and ergonomic design, users will be more inclined to habitually wear the device attached to their clothing, belt, a band or sash, life jacket or safety harness, regardless of how benign the conditions may be. It may also be constructed into clothing and life preserving equipment such as a life jacket, safety harness or life raft, for example. Should the user find themselves in the water, this device may remove a large portion of the searching time, facilitating the rapid location and recovery of the casualty and, therefore, enhancing their chances of survival.

The device is not intended as a primary buoyancy aid or life preserver although there are buoyant compartments as part of the structure that may offer additional buoyancy and relief to a casualty. However, the device may be incorporated into a buoyancy aid or life preserver.

Figure 1:
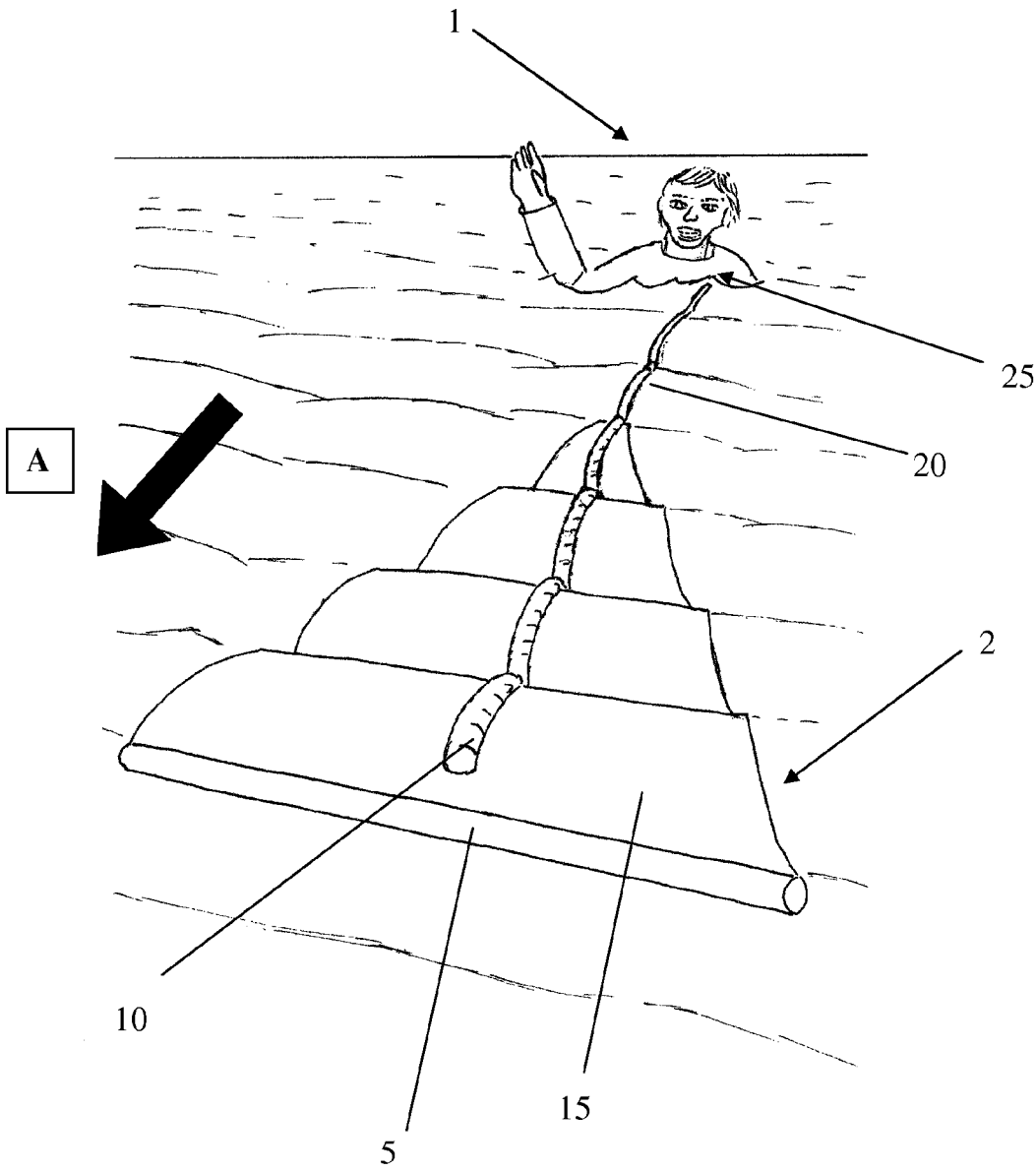
FIG. 1 shows a device according to the invention having been deployed during an emergency.

FIG. 1 shows a user (1) in the water with a deployed device (2) comprising an inflatable portion of at least two linear portions according to the invention. The device comprises an indicator portion (15) which is kept at or near the surface of the water, riding the surface of the waves, by attachment to an inflatable end cell (5) and inflatable spine cell (10). In the illustrated embodiment, the inflated end cell and spine cell together form a "T" shape. The device further comprises a tether (20) which attaches to the user at a pivot point (25) with the result that the whole device extends away from the user by the action of wind and waves (in the direction of arrow A). The user can position himself so that he is facing away from the waves without fear of becoming entangled with the device, since the device will tend to extend away from the user, downwind or downstream regardless of the direction in which the user faces. This is the result of the use of attachment of the device to the user at a pivot point and, in this embodiment, the use of a length of tether material which spatially separates the deployed device from the user.

FIG. 3 shows an undeployed device packaged into a compact unit (30) with tear lines (35) or lines of weakness in the outer packaging material, which allow deployment of the device when the inflatable cells are inflated. FIG. 2 shows a user (1) wearing several undeployed packaged devices (30) to demonstrate various locations on his clothing at which a device can be placed. FIGS. 4 and 5 show rear straps (35) on the packaged device for attaching to belts or epaulets. FIGS. 4 and 6 also show holes (40) for use to attach to clothing or other material (45) by use of a washer and pin system (50).

Figures 7, 8:
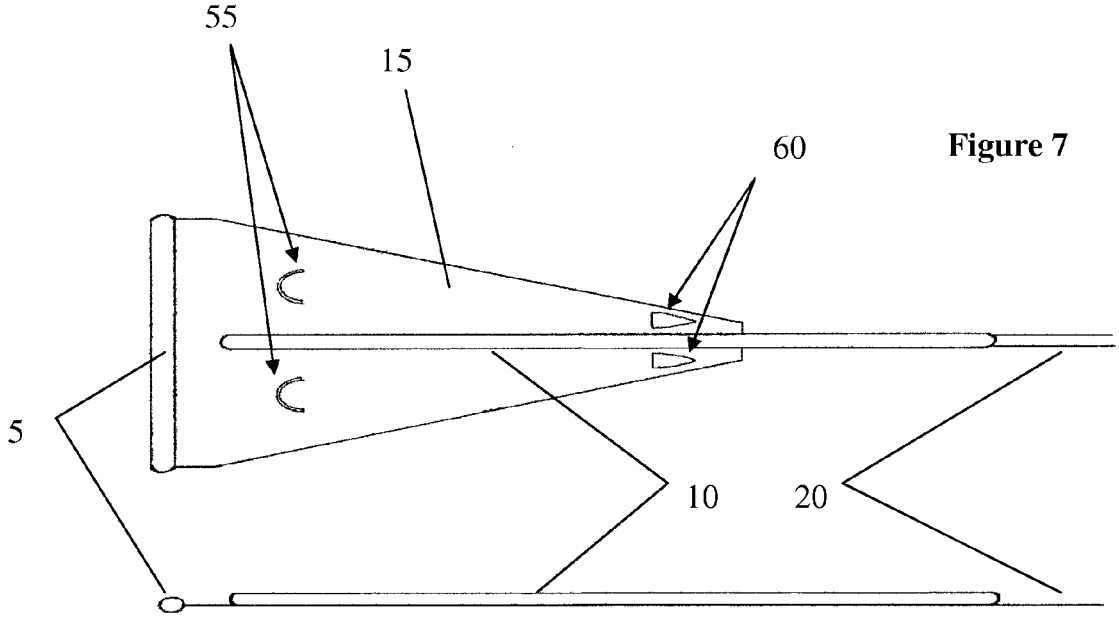
FIG. 7 shows a top view of a deployed device showing a deployed two inflatable linear cell system with sea anchors and vents within a triangular indicator shape.
FIG. 8 shows the deployed device of FIG. 7 viewed from the side, also showing the tether that connects to the device package located on the user.

FIGS. 7 and 8 show one embodiment of the deployed device comprising an end inflatable cell (5) and spine inflatable cell (10) arranged at approximately 90° to one another to form a "T" shape. The cells are of unitary construction with the indicator portion (15) which is, therefore, effectively attached to the inflatable cells along the majority of their length. The spine inflatable cell is attached to a tether (20) which is attachable to a user at a pivot point. Vents (55) assist with keeping the indicator (15) at or near the surface of the water by the action of waves through the vents. A lattice formed in the material of the indicator portion may additionally or alternatively be utilised, to enable to rapid return of the indicator to the surface after submersion. Sea anchors (60) act in a similar way to maintain the position of the device on the surface of the water and reduce drag on the user.

Unlike prior art systems, the device utilises the natural attributes of wind and water to maximise the surface area of the deployed device, thereby maximising the chances of it being detected by a rescuer.

This device is designed to be small, encouraging the user to wear the device permanently, therefore being available and accessible and providing maximum protection to the user. The device may come in a range of designs and specifications best suited to the likely conditions, whilst retaining the smallest possible size for the circumstances.

Inflation of the inflatable cells may be by gas cartridge or cartridges which may be housed in the body of the packaging element, inserted into the sealed cell or cells of the floating indicator, or externally attached to the same. They are of sufficient size to provide sufficient floatation and stiffness to ensure the large area of visible indicator material may retain its basic shape and can return to the surface quickly whenever submerged. Manual inflation by means of a tube and one-way valve may also be utilised.

FIGS. 9 and 10 show a gas cartridge (62) and valve (64) system for use to inflate the device, with actuation of the valve and release of gas being initially prevented by a pre-tensioned spring (65) held in place by a water-soluble band or sheath (70). FIG. 11 shows that such a cartridge may be inserted into an inflatable cell (75) ready for deployment by dissolving the water-soluble band (70) when the device is contacted by water.

A trigger system may comprise one of several configurations or options that may act to release gas from the cartridge to the cell or cells. One may be that, as the indicator portion of the device unfolds into the water, a water activated system causes the gas to be released filling the cell(s). Other substances triggered by contact with moisture may also be utilised. Another example may be a manual trigger to release the gas or any combination of similar methods.

Throughout the description and claims of this specification, the words "comprise" and "contain" and variations of the words, for example "comprising" and "comprises", mean "including but not limited to" and do not exclude other components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Preferred features of each aspect of the invention may be as described in connection with any of the other aspects.

Other features of the present invention will become apparent from the following examples. Generally speaking the invention extends to any novel one, or any novel combination, of the features disclosed in this specification (including any accompanying claims and drawings). Thus, features, integers or characteristics, described in conjunction with a particular aspect, embodiment or example of the invention are to be understood to be applicable to any other aspect, embodiment or example described herein, unless incompatible therewith.

Moreover, unless stated otherwise, any feature disclosed herein may be replaced by an alternative feature serving the same or a similar purpose.

The invention claimed is:

1. Object locator device, convertible between an undeployed state and a deployed state, comprising:

a. an inflatable portion of at least two linear portions arranged such that the inflatable portion is substantially "T" shaped or "┼" shaped when the device is in the deployed state;

b. an indicator portion formed by a sheet and attached to each linear portion;

c. means for attachment of the device to the object at one or more pivot points when the device is in a deployed state;

d. means for inflation of the inflatable portion, wherein, when the device is in the deployed state, the device remains on or near a surface and the indicator portion maintains a substantially flat configuration; and e. wherein one linear portion is inflatable independently from another linear portion.

2. Device according to claim 1 wherein the inflatable portion which is substantially "T" shaped or "┼" shaped is substantially "T" shaped when the device is in the deployed state.

3. Device according to claim 1 convertible between an undeployed state, in which it is packaged to form a substantially flat unit locatable on the surface of the object, and a deployed state in which the inflatable portion is inflated.

4. Device according to claim 1 in which the means for attachment of the device to the object when the device is in the deployed state is means for attachment at a single pivot point.

5. Device according to claim 1 in which the means for inflation is activated automatically.

6. Device according to claim 1 wherein the means for inflation comprises a pressurized gas container which, when triggered, releases gas into the inflatable portion.

7. Device according to claim 6 in which the release of gas from the gas container is triggered by release of trigger means activated by contact with a liquid.

8. Device according to claim 1 wherein the means for inflation comprises manual inflation means.

9. Device according to claim 1 in which the indicator portion comprises at least one flotation vent.

10. Device according to claim 1 wherein all or a part of the device is formed from a high visibility material.

11. Method of visualising an object comprising attaching a device according to claim 1 to the object or to an item attached to the object.

12. Device according to claim 1 wherein the indicator portion is attached to each linear portion along substantially the whole length of each linear portion.

13. Device according to claim 1 wherein the inflatable portion consists of an inflatable end cell and an inflatable spine cell, the inflatable spine cell attached to a tether for attachment of the device to the object.

14. Device according to claim 1 wherein said means for attachment of the device to the object consists of a single length of material.

15. Device according to claim 1 wherein said means for attachment of the device to the object is attached to one of said linear portions.

16. Device according to claim 1 wherein each linear portion of the inflatable portion is formed by a single inflatable chamber.

17. Device according to claim 1 wherein each linear portion comprises a series of inflatable chambers.

18. Object locator device, convertible between an undeployed state and a deployed state, comprising:

a. an inflatable portion of at least two linear portions arranged such that the inflatable portion is substantially "T" shaped or "┼" shaped when the device is in the deployed state;

b. an indicator portion formed by a sheet and attached to each linear portion;

c. means for attachment of the device to the object at one or more pivot points when the device is in a deployed state; and d. means for inflation of the inflatable portion, wherein, when the device is in the deployed state, the device remains on or near a surface and the indicator portion maintains a substantially flat configuration; and e. wherein the inflatable portion consists of an inflatable end cell and an inflatable spine cell, the inflatable spine cell attached to a tether for attachment of the device to the object.

19. Device according to claim 18 wherein the inflatable portion which is substantially "T" shaped or "┼" shaped is substantially "T" shaped when the device is in the deployed state.

* * * * *